US008607872B1

(12) United States Patent
Bugariu

(10) Patent No.: US 8,607,872 B1
(45) Date of Patent: Dec. 17, 2013

(54) FIRE PREVENTION BLOW-OUT VALVE

(71) Applicant: Adrian Bugariu, St. John, IN (US)

(72) Inventor: Adrian Bugariu, St. John, IN (US)

( * ) Notice: Subject to any disclaimer, the term of this patent is extended or adjusted under 35 U.S.C. 154(b) by 0 days.

(21) Appl. No.: 13/905,199

(22) Filed: May 30, 2013

(51) Int. Cl.
*E21B 34/00* (2006.01)

(52) U.S. Cl.
USPC ..... 166/317; 166/316; 166/332.1

(58) Field of Classification Search
USPC ..... 166/332.1, 316, 54.5, 317
See application file for complete search history.

(56) References Cited

U.S. PATENT DOCUMENTS 1,911,323 A * 5/1933 Otis ..... 166/72
3,120,267 A * 2/1964 Bayless ..... 166/53
3,653,439 A * 4/1972 Kisling, III ..... 166/317
3,747,618 A 7/1973 Boes
3,815,675 A * 6/1974 Peters ..... 166/72
3,847,216 A * 11/1974 Boyadjieff et al. ..... 166/72
3,853,175 A * 12/1974 Boyadjieff et al. ..... 166/72
3,861,464 A * 1/1975 Boyadjieff et al. ..... 166/332.8
3,916,992 A * 11/1975 Boyadjieff et al. ..... 166/332.3
3,987,846 A 10/1976 Thompson
3,990,508 A * 11/1976 Boyadjieff et al. ..... 166/72
4,109,713 A 8/1978 Clow
4,316,506 A 2/1982 Poole
4,901,617 A * 2/1990 Malone et al. ..... 84/402
4,944,350 A * 7/1990 Airey ..... 166/373
5,404,953 A 4/1995 Sangesland
5,771,974 A 6/1998 Stewart et al.
6,435,282 B1 * 8/2002 Robison et al. ..... 166/386
7,114,563 B2 * 10/2006 Rose ..... 166/254.2
7,409,999 B2 8/2008 Henriksen et al.
7,588,084 B2 * 9/2009 Hallundbæk ..... 166/297

* cited by examiner

*Primary Examiner* — David Andrews
*Assistant Examiner* — Michael Wills, III

(57) ABSTRACT

The present invention comprises fire arrestor device a triggering mechanism operatively connected to a well head and a plunger with a plug at one end being connected to the triggering mechanism. A guide and a valve are mounted to an inner surface of oil piping positioned below the well head align the plunger. A plug is formed at the distal end of the plunger, and is seated on a spring below the valve seat. The spring is held in compressed mode during normal operation. In the event of destruction of the well head, the triggering mechanism will melt or break. The spring then urges the plug upward engaging the valve seat and shutting off the fuel flow.

3 Claims, 3 Drawing Sheets

FIRE PREVENTION BLOW-OUT VALVE

BACKGROUND OF INVENTION

The present invention relates to a remotely activated or automatically activated fire arrestor designed to shut off oil or gas flow in the event of a well head rupture.

The device is designed to shut off oil flow and retard oil well or oil refinery fires. The destruction of a triggering mechanism will prevent and arrest the escalation of an oil or gas well fire. The device is placed underground, between the oil pool and the well head on the surface, so that it is not easily detectable nor is it easily circumvented by terrorist or other forces. The device will help counter the threat of terrorist or subversive forces from blowing up oil/gas wells, by arresting the escalation of fire before it becomes out of control.

SUMMARY OF THE INVENTION

The general purpose of the present invention, which will be described subsequently in greater detail, is to provide a new and improved fire prevention blow out valve device mounted in standard oil field piping.

To attain this, the present invention, comprises a triggering mechanism operatively connected to a well head and a plunger connected to the triggering mechanism. A guide, having a passage therethrough to align the plunger, is mounted to an inner surface of oil piping positioned below the well head.

A valve seat, having passage therethrough to also align the plunger, is integrally formed to the inner surface of the oil piping. A plug is formed at the distal end of the plunger, and is seated on a spring. The spring is mounted on a rim formed within the inner surface of the piping.

The plug in the open position allows the flow of oil during normal operation. The spring is held in compressed mode during normal operation. In the event of destruction of the well head, the triggering mechanism will melt or break. The spring then urges the plug upward into the valve seat, shutting off the fuel flow.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
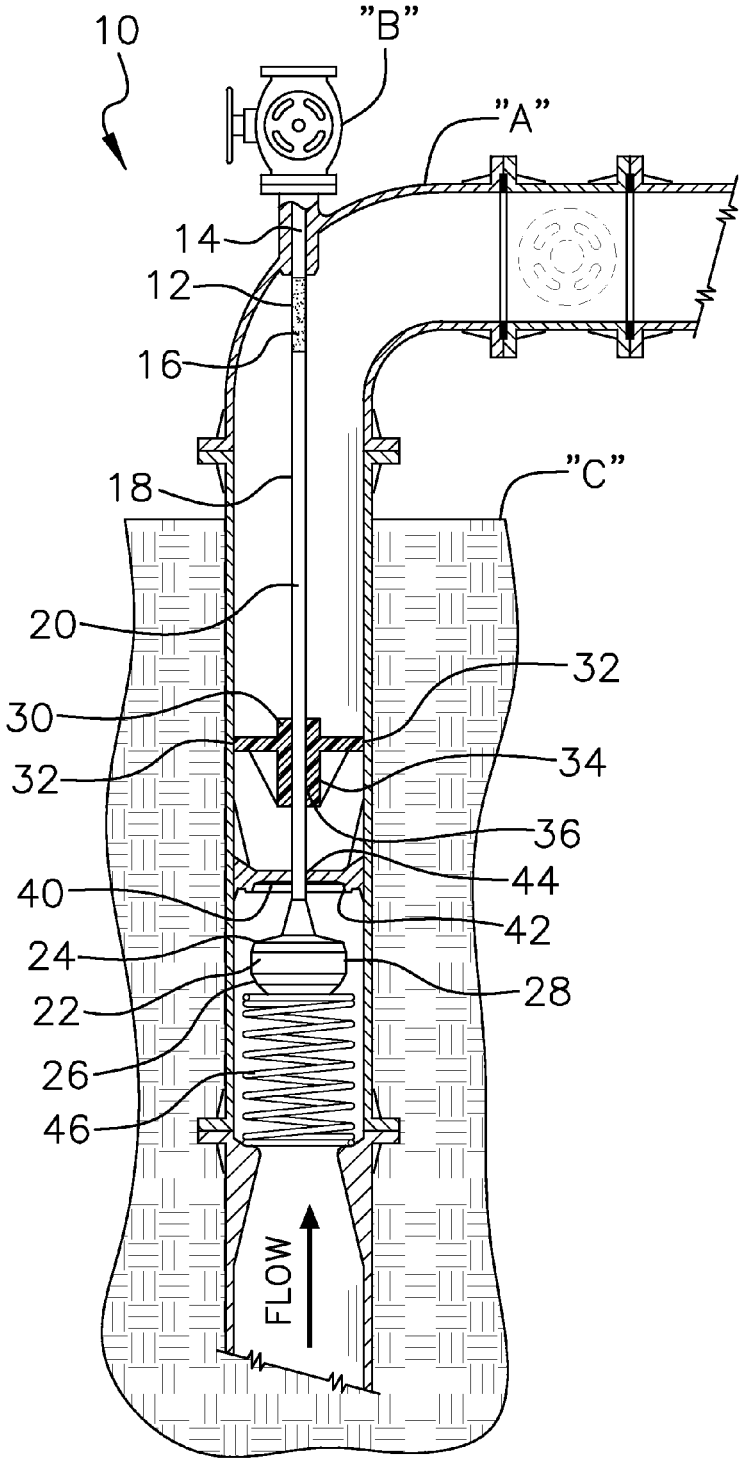
FIG. 1 is a cross-sectional view of the present invention mounted in oil field piping during normal operation.
Figure 2:
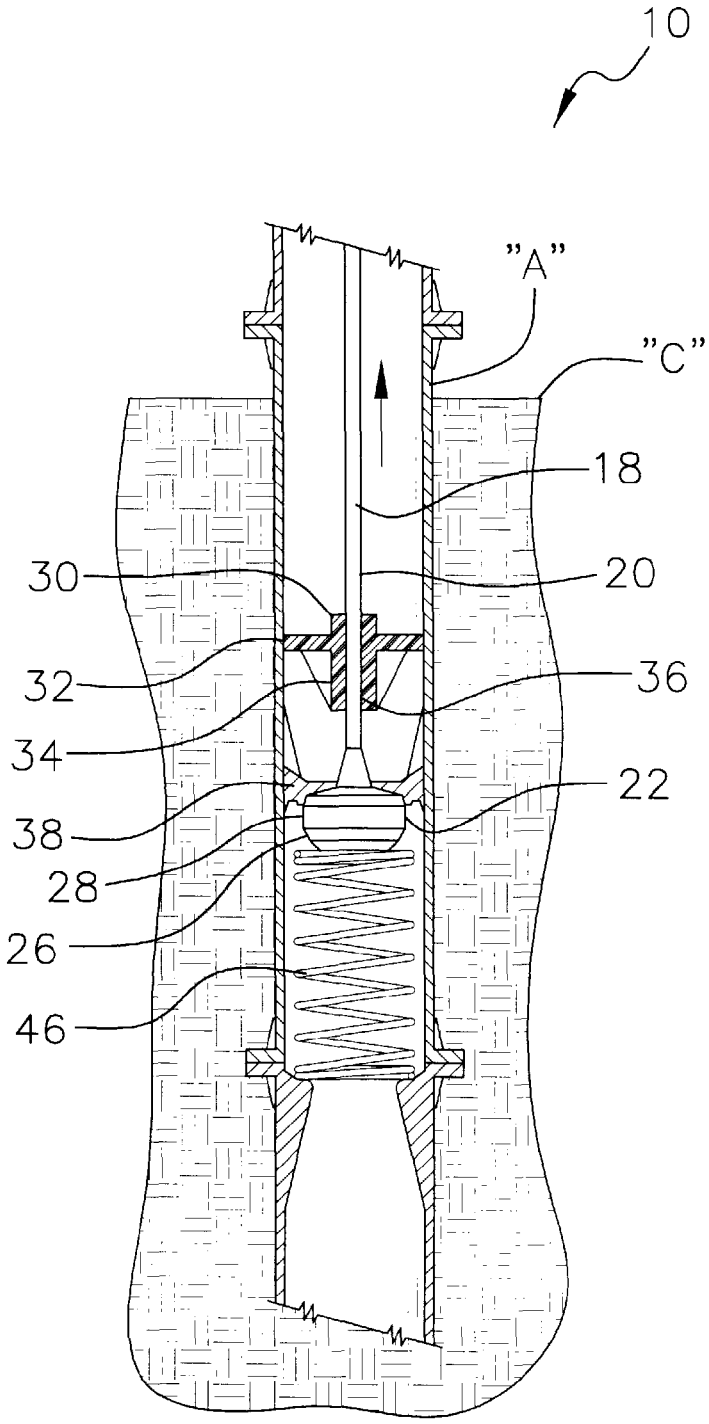
FIG. 2 is cross-sectional view of the present invention after the triggering means has been destroyed and the plug is mated with the valve seat.

In reference to FIGS. 1 and 2, the invention, denoted generally by reference numeral 10, is shown mounted within an inner surface of standard oil field piping (referenced generally as "A"). The device 10 comprises a triggering mechanism 12 comprised of a first end defining a rod 14 engaged with a well head (referenced as "B" positioned above ground level "C"), and triggering means 16 integrally formed at a second end. The triggering means 16 is composed of material that will melt from the temperature of intense fires or break if stressed. The rod 14 is formed of resilient material such as cast iron.

A plunger 18 comprised of a rod 20 and a plug 22 is attached at a first end to the triggering mechanism 12 contiguous the triggering means 16. The plug 22 is defined at a second end of the plunger 18, and has an outer panel 24 and an inner panel 26. The outer panel 24 has a sloping surface generally hemispherical in appearance, and is tapered from the outer perimeter of the rod 20 to a circular perimeter planer surface 28 defining the outer perimeter of the plug 22. It should be recognized that the elevation of the outer panel 24 is not limited to any particular angle of slope. The slope of the inner panel 26 is also generally domed-shaped in appearance.

A guide 30 having an annular flange 32 is mounted to the inner surface of the piping. A generally cylindrical case 34 with a bore 36 therethrough is formed through a central portion of the guide 30 positioned for receiving the rod 20 of the plunger 18.

A valve seat 38 having a first section defining an upper interior planer surface 40 and a second section defining a lower interior planer surface 42, and a passage 44 defined therethrough to allow the flow of oil or gas, is mounted to the inner surface of the piping. The valve seat 38 is positioned so that it is in substantial alignment with the guide 30. The upper interior planer surface 40 is smaller in diameter and concentrically located with respect to the lower interior planer surface 42. The lower interior planer surface 42 is tapered downwardly.

The rod 20 of the plunger 18 aligns through the bore 36 of the guide 30 and the passage 44 of the valve seat 38. The plug 22 is aligned below the valve seat 38. A spring 46 is mounted along an edge formed within the piping. The plug 22 mounts on the spring 46. In operation, the triggering mechanism 12 and the plunger 18 are pressed downwardly by the well head, and in turn compress the spring 46 downwardly. The valve seat 38 is kept in the open position, allowing the normal flow of oil.

In the event of the destruction of the well head, the triggering means 16 of the triggering mechanism 12 will melt or break. Energy stored during the compression of the spring 46 urges the plug 22 upwardly to hermetically seal the outer panel 24 of the plug 22 against the lower interior planer surface 42 of the valve seat 38. FIG. 2 illustrates the movement of the spring 46 after the destruction of the triggering means 16. Further fuel flow is prevented and the fire stopped.

Figure 3:
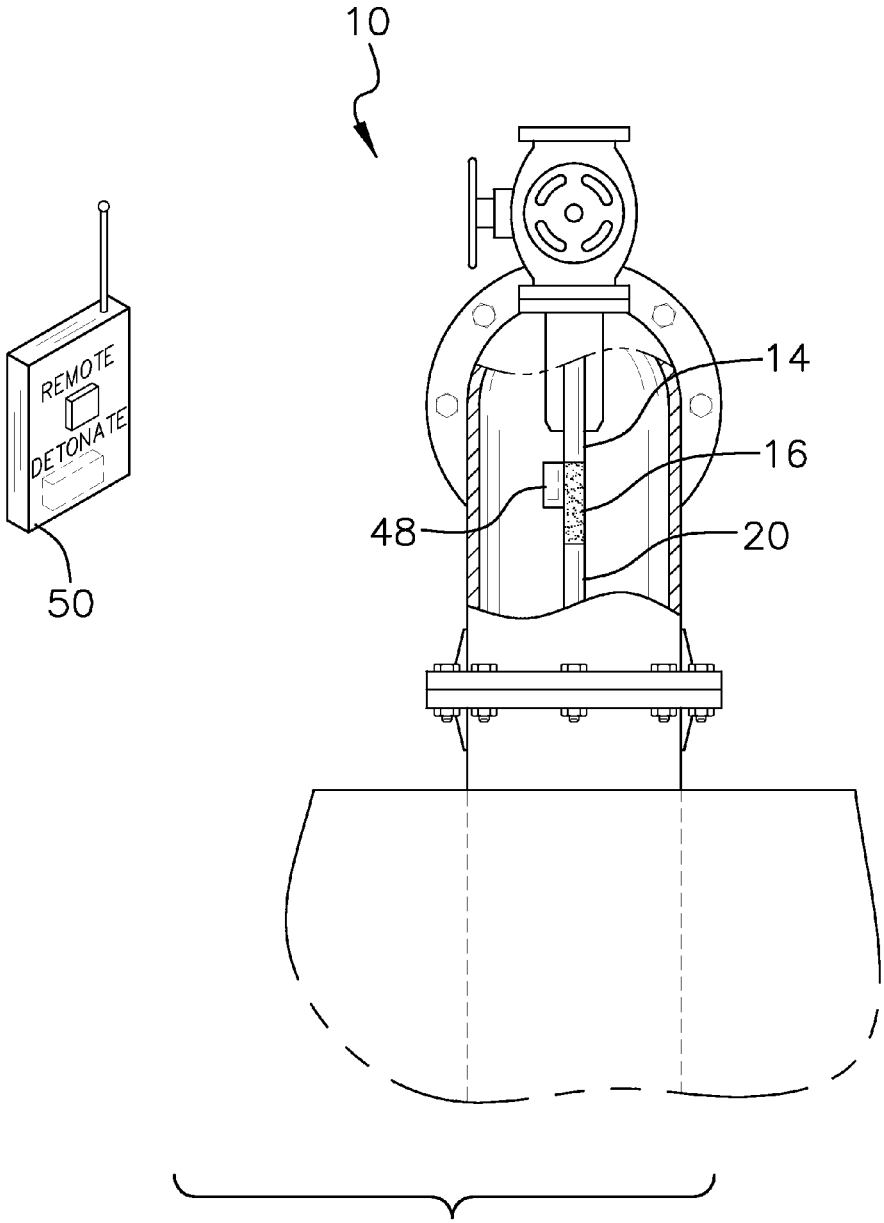
FIG. 3 is a fragmentary cross-sectional view of the invention illustrating a remote activation device associated with the triggering means.

As illustrated in FIG. 3, the triggering mechanism 12 may be integrally formed with a remote sensor 48. When needed a user can activate a remote transmitter 50 communicating with the sensor 48 causing the destruction of the triggering means and closing the flow of oil. The sensor 48 and the transmitter 50 are well known in the prior art, and will not be further described.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fire prevention valve device mounted to an inside surface of oil field piping below a well head, comprising in combination:

a triggering mechanism having a first end comprised of a first rod operatively connected to the well head and further having triggering means integrally formed at a second end;

a plunger having a second rod at a first end attached to the triggering mechanism and a plug integrally formed at a second end of the plunger, whereby the plug comprises an outer panel having a sloping surface tapered from the rod to a circular perimeter planer surface defining an outer perimeter of the plug and an inner panel generally dome-shaped in appearance depending downwardly from the circular perimeter planer surface;

a valve seat having an upper interior planer surface and a lower interior planer surface, whereby the upper interior planer surface is smaller in diameter and concentrically located with respect to the lower interior planer surface, and a passage formed therethrough to allow the flow of oil and to align the plunger, and whereby the plug is aligned below the valve seat;

a spring aligned below the valve seat, and whereby the inner panel of the plug is positioned on the spring whereby the trigger mechanism and the second plunger are pressed downwardly by the wellhead, and in turn compresses the spring downwardly; and whereby when the triggering means of the triggering mechanism is destroyed the spring urges the plug upwardly against the valve seat stopping the flow of oil.

2. The device of claim 1, further comprising a guide mounted to the inner surface of the piping and a case with a bore therethrough formed through a central portion of the guide positioned for receiving the plunger.

3. A fire prevention valve device mounted to an inside surface of oil field piping below a well head, comprising in combination:

a triggering mechanism having a first end comprised of a first rod operatively connected to the well head and further having triggering means integrally formed at a second end;

a remote sensor integrally formed with the triggering mechanism;

a remote transmitter;

a plunger having a second rod at a first end attached to the triggering mechanism and a plug integrally formed at a second end of the plunger, whereby the plug comprises an outer panel having a sloping surface tapered from the rod to a circular perimeter planer surface defining an outer perimeter of the plug and an inner panel generally dome-shaped in appearance depending downwardly from the circular perimeter planer surface;

a valve seat having an upper interior planer surface and a lower interior planer surface, whereby the upper interior planer surface is smaller in diameter and concentrically located with respect to the lower interior planer surface, and a passage formed therethrough to allow the flow of oil and to align the plunger, and whereby the plug is aligned below the valve seat;

a spring aligned below the valve seat, and whereby the inner panel of the plug is positioned on the spring whereby the trigger mechanism and the second plunger are pressed downwardly by the wellhead, and in turn compresses the spring downwardly;

and whereby when the triggering means of the triggering mechanism is destroyed the spring urges the plug upwardly against the valve seat stopping the flow of oil.

* * * * *